US011649135B2

(12) United States Patent
Brakensiek et al.

(10) Patent No.: US 11,649,135 B2
(45) Date of Patent: May 16, 2023

(54) TEXTILE MACHINE PRODUCING CROSS-WOUND PACKAGES, COMPRISING A CROSS-WOUND PACKAGE TRANSPORT APPARATUS

(71) Applicant: Saurer Spinning Solutions GmbH & Co. KG, Uebach-Palenberg (DE)

(72) Inventors: Dirk Brakensiek, Neuss (DE); Robert Geisler, Wegberg (DE); Wolfgang Doerner, Mönchengladbach (DE); Bodo Hansen, Erkelenz (DE); Tai Mac, Würselen (DE); Erwin Peters, Düren (DE); Eduard Prediger, Mönchengladbach (DE); Philipp Schiffers, Erkelenz (DE); Michael Spitzer, Korschenbroich (DE); Jonathan Sprecher, Aachen (DE); Heiko Toepke, Baesweiler (DE); Lothar Winzen, Herzogenrath (DE)

(73) Assignee: Saurer Spinning Solutions GmbH & Co. KG, Übach-Palenberg (DE)

( * ) Notice: Subject to any disclaimer, the term of this patent is extended or adjusted under 35 U.S.C. 154(b) by 343 days.

(21) Appl. No.: 16/716,982

(22) Filed: Dec. 17, 2019

(65) Prior Publication Data

US 2020/0189860 A1 Jun. 18, 2020

(30) Foreign Application Priority Data

Dec. 17, 2018 (DE) ..... 10 2018 132 462.6

(51) Int. Cl.
*B65H 67/04* (2006.01)
*D01H 9/18* (2006.01)
(Continued)

(52) U.S. Cl.
CPC ..... *B65H 67/0411* (2013.01); *B65H 54/26* (2013.01); *B65H 67/06* (2013.01); *D01H 9/18* (2013.01); *B65H 2701/31* (2013.01)

(58) Field of Classification Search
CPC .. B65H 67/0411; B65H 67/06; B65H 67/064; D01H 9/18
See application file for complete search history.

(56) References Cited

U.S. PATENT DOCUMENTS

2015/0016927 A1 1/2015 Troitzsch

FOREIGN PATENT DOCUMENTS

CN 85109416 A 9/1986
CN 104528467 A 4/2015
(Continued)

OTHER PUBLICATIONS

Chinese Office Action from Chinese Patent Application No. 201911280743.8, dated Mar. 22, 2021, all enclosed pages cited.

*Primary Examiner* — William E Dondero
(74) *Attorney, Agent, or Firm* — Nelson Mullins Riley & Scarborough LLP

(57) ABSTRACT

A textile machine for producing cross-wound packages, the machine being equipped with a plurality of workstations arranged next to one another on both longitudinal sides of the machine and having a cross-wound package transport apparatus. The cross-wound package transport apparatus has a first transport device, arranged between the two rows of workstations for conveying cross-wound packages, and a handling apparatus for moving cross-wound packages from the first transport device to the second transport device. The handling apparatus is arranged between the end regions of the first transport device.

9 Claims, 2 Drawing Sheets

(51) Int. Cl.
*B65H 67/06* (2006.01)
*B65H 54/26* (2006.01)

(56) References Cited

FOREIGN PATENT DOCUMENTS

| | | | |
|---|---|---|---|
| CN | 205076561 | U | 3/2016 |
| DE | 3244015 | A1 | 5/1984 |
| DE | 35 11 815 | A1 | 10/1986 |
| DE | 38 28 592 | A1 | 3/1989 |
| DE | 40 37 084 | A1 | 5/1992 |
| DE | 42 14 683 | C2 | 11/1993 |
| DE | 4222723 | A1 | 1/1994 |
| DE | 10 2006 009 398 | A1 | 9/2007 |
| DE | 10 2014 107 508 | A1 | 12/2015 |
| DE | 102015008378 | A1 | 12/2016 |

TEXTILE MACHINE PRODUCING CROSS-WOUND PACKAGES, COMPRISING A CROSS-WOUND PACKAGE TRANSPORT APPARATUS

CROSS-REFERENCE TO RELATED APPLICATIONS

This application claims priority from German National Patent Application No. 10 2018 132 462.6, filed Dec. 17, 2018, entitled "Kreuzspulen herstellende Textilmaschine mit einer Kreuzspulentransporteinrichtung", the entire contents of which are incorporated herein by reference.

FIELD OF THE INVENTION

The invention relates to a textile machine producing cross-wound packages, the textile machine being equipped with a plurality of workstations arranged next to one another on both longitudinal sides of the machine, to a cross-wound package transport apparatus arranged between the two rows of workstations, and to a handling apparatus for moving cross-wound packages.

BACKGROUND OF THE INVENTION

Textile machines that produce cross-wound packages, comprising a plurality of workstations arranged next to one another on both longitudinal sides of the machine, and transport apparatuses for cross-wound packages have long been known, in particular in relation to open-end rotor spinning machines, and have been described in numerous patent applications, in some cases in great detail.

Open-end rotor spinning machines of this kind generally have a plurality of identical workstations arranged next to one another, both in the region of the front longitudinal machine side thereof and in the region of the rear longitudinal machine side thereof. These workstations are each equipped with a spinning device and a winding device. A transport device extending along the entire length of the machine is often arranged between the two rows of workstations, by means of which transport device the cross-wound packages completed on the workstations can be conveyed to a package removal apparatus arranged at the end of the machine.

The cross-wound package transport apparatuses of this kind of open-end rotor spinning machine have either a single conveyor belt arranged in the middle, as described for example in German Patent Publication DE 40 37 084 A1 German Patent Publication DE 42 14 683 C2 or German Patent Publication DE 10 2014 107 508 A1, or two conveyor belts running in parallel and arranged next to one another in the middle, as disclosed for example in German Patent Publication DE 38 28 592 A1.

As is known, and thus not described again, cross-wound packages are produced on the workstations of this kind of open-end rotor spinning machine from fiber bands, which are provided in what are known as spinning cans, and said packages are processed further on downstream textile machines, such as weaving machines. In other words, the winding apparatuses of the workstations of this kind of open-end rotor spinning machine constantly wind up cross-wound packages, which are transferred to the transport device extending along the entire length of the machine by means of automatic operating units, such as package doffers, and conveyed by said device to package removal apparatuses arranged at the end of the machine.

At the package removal apparatus, the complete cross-wound packages are then taken off the transport device manually or mechanically, and reloaded for example into package transport vehicles or other downstream transport apparatuses.

To prevent cross-wound packages from colliding when transferring finished cross-wound packages from the winding apparatuses to the cross-wound package transport device extending along the entire length of the machine, it should be ensured as far as possible that the conveyor belt space behind the winding apparatus of the workstation that has completed the cross-wound package, and needs emptying quickly, is empty. In other words, it should be ensured that the cross-wound package being transferred cannot collide with one or more cross-wound packages already present on the conveyor belt. Collisions can be prevented by monitoring the conveyor belt space, but in that case the winding apparatus is stopped if the conveyor belt space is not empty since the full cross-wound package cannot be removed, thus leading to a reduction in efficiency.

Therefore, to prevent cross-wound package collisions of this kind and/or winding apparatus stoppages when transferring cross-wound packages to a conveyor belt extending along the entire length of the machine, various removal strategies have been developed in the past.

In one known method, for example, each finished cross-wound package is transferred to the conveyor belt as quickly as possible and immediately conveyed to a package removal apparatus arranged at the end of the machine, where the cross-wound package is immediately unloaded, i.e. immediately passed on to a downstream transport device or the like.

In a method of this kind, however, the transport device has to be stopped in order to receive and deposit each cross-wound package, i.e. this kind of removal strategy ultimately leads to stop-and-go operation, which not only places great strain on the transport device, but also often has a detrimental effect on the cross-wound packages, which are generally relatively sensitive.

In another method often used in practice, the two cross-wound package transport apparatus conveyor belts arranged between the rows of workstations are first stopped and then successively loaded with cross-wound packages. The full or almost full conveyor belts are then actuated such that the cross-wound packages are conveyed to package removal apparatuses arranged at the end of the machine, where they are unloaded one after the other.

However the drawback of this method is that in long machines, in particular in the case of multi-lot occupancy, additional cross-wound packages cannot be set down due to the cross-wound packages already present on a conveyor belt, with the consequence that a plurality of workstations have to be stopped and wait because their finished cross-wound package cannot be immediately deposited onto the conveyor belt. In particular, the cross-wound package backlog beginning in the region of the package removal apparatuses often leads to problems when transferring the cross-wound packages, especially at the workstations arranged at the end of the machine, i.e. adjacently to the package removal apparatuses. In other words, these workstations can often not deposit their finished cross-wound packages onto the conveyor belt. Since, as indicated above, the affected workstations of the open-end rotor spinning machine cannot operate during their standby time, the efficiency of such textile machines often drops considerably.

Another method used for removing cross-wound packages at workstations of an automatic winding machine is described in German Patent Publication DE 35 11 815 A1. In this known method, the automatic winding machine is equipped with a package doffer, which takes the finished cross-wound packages one after the other from the winding devices of the workstations and transports them to a package transfer point arranged at the end of the machine. A package transfer apparatus, which can be actuated by the package doffer, is arranged in the region of the package transfer point and ensures that each cross-wound package is transferred immediately to a conveyor belt installed above the workstations. This conveyor belt is then advanced by one package width to create space for receiving a new cross-wound package. If the conveyor belt is full, the cross-wound packages are either ejected onto a downstream conveyor belt or transferred temporarily to a storage apparatus arranged above the conveyor belt.

A similar device for removing cross-wound packages at the workstations of a textile machine producing cross-wound packages is also described in German Patent Publication DE 10 2006 009 398 A1. According to this reference, an open-end rotor spinning machine is equipped with a continually circulating cross-wound package transport device that is arranged above the workstations and, as is common, is supplied with finished cross-wound packages by a package doffer.

A lifting device is installed at the end of the crass-wound package transport device and immediately transfers the delivered cross-wound packages to a storage apparatus in the form of a conveyor belt arranged above or below the cross-wound package transport apparatus. By means of the lifting device, the storage apparatus can then also be unloaded as necessary.

A drawback of the above-described apparatuses is, among other things, that the package transfer apparatus is arranged at the end of the cross-wound package transport device. In these known apparatuses, in particular in the case of long open-end rotor spinning machines, there is always the risk that a cross-wound package backlog will occur, i.e. that the cross-wound packages already present on the cross-wound package transport apparatus prevents additional cross-wound packages completed by the workstations from being placed down in a timely manner.

On the basis of the above-described prior art, the problem addressed by the invention is that of developing a textile machine producing cross-wound packages to comprise a package removal apparatus that is configured in such a way that in particular a cross-wound package backlog on the conveyor belts of the cross-wound package transport apparatus is reliably prevented.

This problem is solved by a textile machine producing cross-wound packages that is equipped with a plurality of workstations arranged next to one another on both longitudinal sides of the machine and has a cross-wound package transport apparatus. The cross-wound package transport apparatus has a first transport device, arranged between the two rows of workstations for conveying cross-wound packages, and a handling apparatus for moving cross-wound packages from the first transport device to the second transport device. According to the invention, the handling apparatus is arranged between the ends of the first transport device.

The dependent claims relate to advantageous configurations of the invention.

The configuration according to the invention of the cross-wound package transport apparatus of a textile machine producing cross-wound packages is a design that can ensure secure and rapid transport of finished cross-wound packages in a relatively simple manner, i.e. a design that prevents new cross-wound packages being unable to be placed down due to cross-wound packages already present on the first transport device.

In particular, the use of a first transport device having a handling apparatus, which is installed between the ends of the first transport device of the textile machine producing cross-wound packages and connects the first transport device to a downstream second transport device, reliably prevents a backlog of finished cross-wound packages at the end of the first transport device, which would severely impair the operation of the workstations arranged in this region of the first transport device since the workstations would be unable to deposit finished cross-wound packages onto the first transport device and would therefore have to be temporarily stopped.

According to the invention, the handling apparatus for moving cross-wound packages from the first transport device to the second transport device is located between the end regions of the first transport device. The end regions are not part of this region. When viewed in the longitudinal direction, the handling apparatus is located within the machine in the region in which the workstations are arranged. The handling apparatus is positioned such that additional cross-wound packages of the workstations can be deposited onto the first transport device in the transport direction downstream of the handling apparatus. By transporting the finished cross-wound packages away by means of the handling apparatus, the path that the cross-wound packages must cover on the first transport device is shortened. The cross-wound packages can thus be removed from the first transport device more quickly. In addition, space for additional cross-wound packages is created on the first transport device.

Preferably, the handling apparatus is arranged in the region of the machine centre. Each finished cross-wound package must therefore be transported on the first transport device at most over half the length of the machine.

According to a further preferred embodiment, the handling apparatus can be movable between the ends or end regions of the first transport device. The position of the handling apparatus can thus be adapted to different capacity utilisation of the workstations and the distribution of the finished cross-wound packages.

It is also possible to distribute a plurality of handling apparatuses over the length of the first transport device.

The first transport device preferably comprises a conveyor belt. In an advantageous embodiment, the first transport device has two conveyor belts, which are arranged next to one another and can be driven in a defined manner, each of the two conveyor belts being equipped with its own handling apparatus. The second transport device can also have two conveyor belts. Each of the two conveyor belts of the first transport device can be connected to one of the conveyor belts of the second transport device by means of the relevant handling apparatus. A configuration of this kind is advantageous in that each of the two rows of workstations of the textile machine producing cross-wound packages has its own cross-wound package transport apparatus, each of which is divided into two longitudinal portions and can be driven separately, thereby ensuring that finished cross-wound packages are smoothly transferred to the associated transport device at all times and are transferred therefrom to package removal apparatuses preferably arranged at the end of the machine.

The above-described embodiment leads to the cross-wound packages being handled particularly gently, since they always rest on the conveyor belt over a large surface area of their package surface, both when being transferred onto the conveyor belt and when being transported for a relatively brief time.

Preferably, the handling apparatus for the cross-wound packages is configured as a cross-wound package lifting apparatus, which takes the cross-wound packages from the first transport device and transfers them to the second transport device. A cross-wound package lifting apparatus is distinguished in that the cross-wound packages are taken away upwards. This is particularly advantageous because the space available to the sides is restricted by the rows of workstations. Advantageously, a cross-wound package lifting apparatus can be used in conjunction with a second transport device arranged above the first transport device. Likewise, however, a cross-wound package lifting apparatus can be used together with a second transport device positioned next to the first transport device.

In textile machine construction, cross-wound package lifting apparatuses of this kind are tried and tested components known in various embodiments, but they are generally arranged at the end of the machine of a cross-wound package transport apparatus.

By way of example, DE 35 11 815 A1 describes an automatic winding machine that has a cross-wound package lifting apparatus arranged in the region of a machine end frame. DE 10 2006 009 398 A describes a cross-wound package lifting device installed at the end of the machine, but in relation to an open-end spinning machine.

Arranging the conveyor belts of the second transport device above the conveyor belts of the first transport device is not only advantageous because the installation space required by a textile machine producing cross-wound packages configured in this manner is minimised, but it also ensures that the workstations of the textile machine remain easily accessible for operators.

In an alternative embodiment, however, the conveyor belts of the second transport device can each be positioned next to the conveyor belts of the first transport device.

In an embodiment of this kind, the space required by the textile machine is greater, but the conveyor belts of the second transport device remain easily accessible for operators. In other words, if there are problems in the region of the conveyor belts of the transport devices, operators can intervene immediately without great difficulty.

In a further advantageous embodiment, a package removal apparatus is installed both at the ends of the conveyor belts of the first transport device and at the ends of the conveyor belts of the second transport device. A configuration of this kind ensures that all the conveyor belts can be unloaded relatively quickly at all times, and so cross-wound package backlogs, which would have a very detrimental effect on the efficiency of the workstations in the region of any backlog, can be reliably prevented.

In a further alternative embodiment, handling apparatuses are arranged both between the end regions of the first transport device and at the end of the first transport device, and transfer finished cross-wound packages to a downstream transport means.

An embodiment of this kind can also ensure, in a relatively simple manner, that finished cross-wound packages are rapidly and securely transported away, thereby reliably preventing the placing down of newly finished cross-wound packages on the first transport devices in the region of the workstations leading to a backlog.

Further details of the invention can be taken from the embodiment examples presented below on the basis of the drawings.

DETAILED DESCRIPTION OF THE INVENTION

Figure 1:
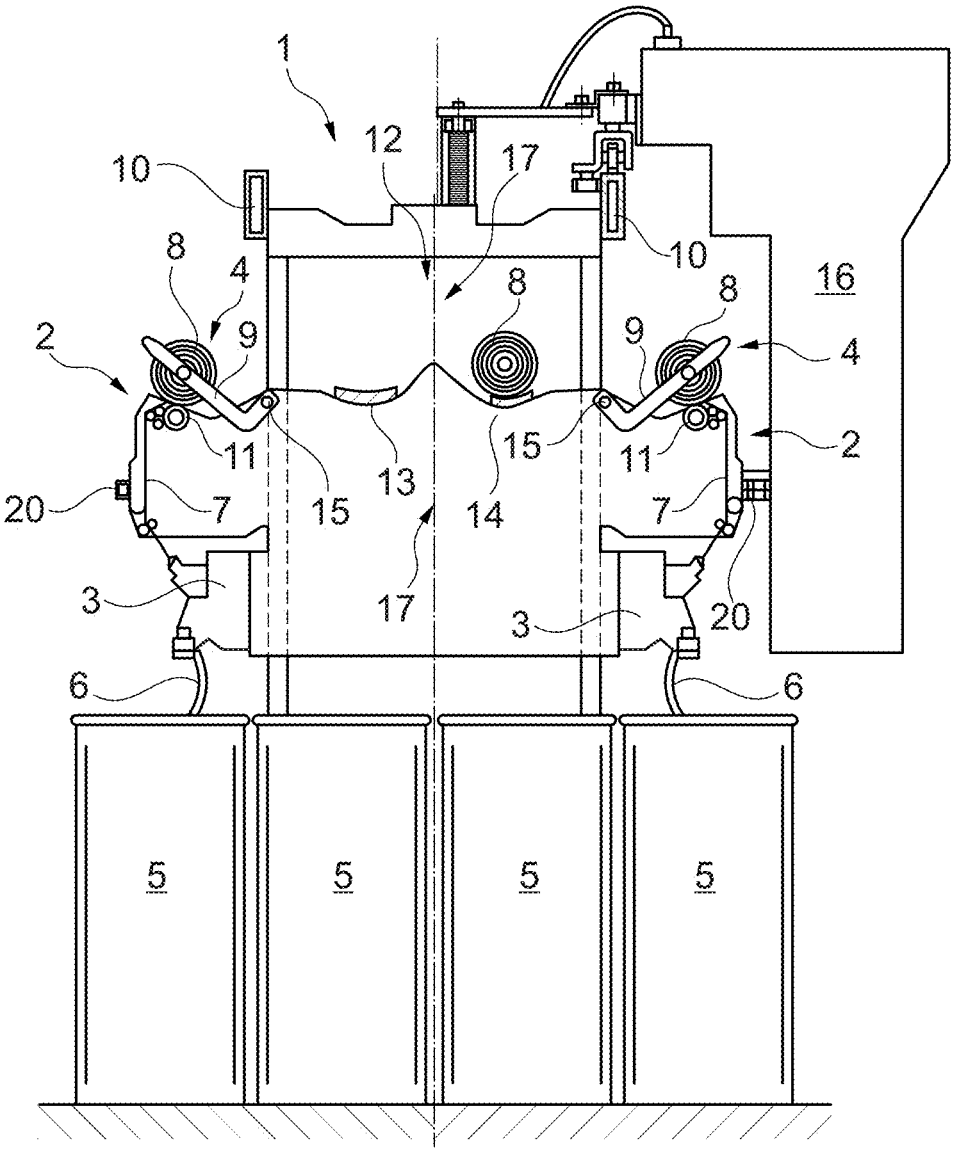
FIG. 1 is a side view of an open-end rotor spinning machine comprising two rows of workstations, a cross-wound package transport apparatus, which is arranged between the two rows of workstations and has two conveyor belts running in parallel, and a package doffer positioned in front of a workstation.

Referring to the figures, FIG. 1 is a side view of the two rows of workstations of a textile machine producing cross-wound packages, in the embodiment example of an open-end rotor spinning machine 1. As is known, open-end rotor spinning machines 1 of this kind have a plurality of identical workstations 2, which are generally arranged in two rows of workstations. In other words, a plurality of identical workstations 2 are positioned both in the region of the front of the textile machine and in the region of the rear of the textile machine.

As can be seen, a cross-wound package transport apparatus 12 is arranged between the two rows of workstations, the first transport device 17 of said transport apparatus being formed, for example, by two conveyor belts 13, 14 running in parallel.

As is known, the workstations 2 of such textile machine each have an open-end rotor spinning device 3 and a winding apparatus 4, among other things.

By means of the open-end rotor spinning apparatus 3, a fibre band 6 stored in a spinning can 5 is spun into a thread 7, which is then wound into a cross-wound package 8 on the winding devices 4.

As shown in FIG. 1, the winding devices 4 are each equipped with a package cradle 9 for rotatably mounting a cross-wound package tube and, in this embodiment example, with a winding roller 11 for the frictionless driving of the cross-wound packages 8 and the simultaneous traversing of the running thread 7. In this case, the package cradle 9 is rotatably mounted in a restricted manner, preferably about a pivot axis 15.

Additionally, open-end rotor spinning machines 1 of this kind are often equipped with a cross-wound package transport apparatus 12 for conveying finished cross-wound packages 8, i.e. with a device for transporting away cross-wound packages 8 that have reached an intended diameter on the workstations 2. The cross-wound package transport apparatus 12 configured according to the invention has a first transport device 17, which has two conveyor belts 13, 14 arranged in parallel, i.e. each of the rows of workstations is equipped with its own conveyor belt 13 and 14, respectively.

Automatic service units, e.g. what are known as package doffers 16, that can be moved on corresponding rails 10 or 20 are also arranged at or on the open-end rotor spinning machine 1. The package doffers 16 patrol along the workstations 2 of the open-end rotor spinning machine 1 during spinning operation and intervene automatically if action is required at any of the workstations 2. Such a need for action arises, for example, if one of the cross-wound packages 8 reaches its prescribed diameter at any of the workstations 2 and has to be exchanged for a new cross-wound package tube.

In this case, the package doffer 16 positions itself in front of the relevant workstation 2 and transfers the full cross-wound package 8 from the package cradle 9 of the winding device 4 of the relevant workstation 2 onto the associated conveyor belt 13 or 14 of the cross-wound package transport apparatus 12. Next, a new cross-wound package tube is swapped into the package cradle 9 and the spinning and winding process is restarted on the relevant workstation 2.

In this case, the cross-wound package transport apparatuses 12 of open-end rotor spinning machines 1 can have various embodiments.

Figure 2:
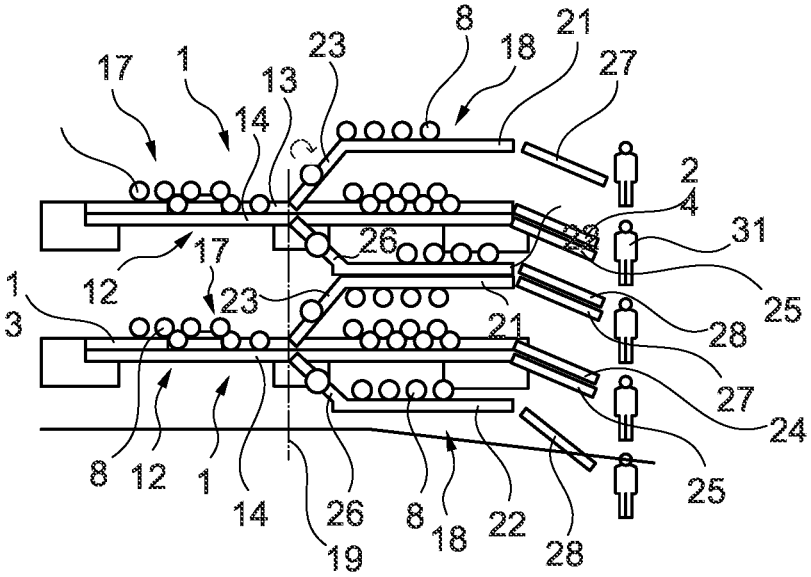
FIG. 2 is a schematic plan view of two adjacent open-end rotor spinning machines each equipped with a cross-wound package transport apparatus, each of which, in a first embodiment according to the invention, has a first transport device having a cross-wound package handling apparatus, which is arranged in the centre of the machine and to which a second transport device is connected, said second transport device being arranged to the side next, to the first transport device.

As shown in the schematic plan view of FIG. 2 on the basis of two adjacent open-end rotor spinning machines 1, in a first embodiment the open-end rotor spinning machines 1 are, for example, each equipped with a cross-wound package transport apparatus 12, which has a first transport device 17 and a second transport, device 18 arranged next to the first transport device 17.

In the process, the first transport device 17 has two conveyor belts 13, 14 extending along the entire length of the machine, which are arranged next to one another and to which the conveyor belts 21, 22 of a second transport device 18 are connected by means of package handling apparatuses 23, 26, for example in the region of the machine centre 19 of the open-end rotor spinning machine 1. As can be seen from FIG. 2, the conveyor belts 21, 22 of the second transport device 18 are half the length of the machine and are each positioned to the side next to one of the conveyor belts 13, 14 of the first transport device 17.

At the end of the machine, the conveyor belts 13, 14 of the first transport device 17 and the conveyor belts 21, 22 of the second transport device 18 are equipped with package removal apparatuses. The package removal apparatuses of the conveyor belts 13, 14 are denoted by reference numerals 24, 25, whereas the package removal apparatuses of the conveyor belts 21, 22 bear the reference numerals 27, 28.

Figure 3:
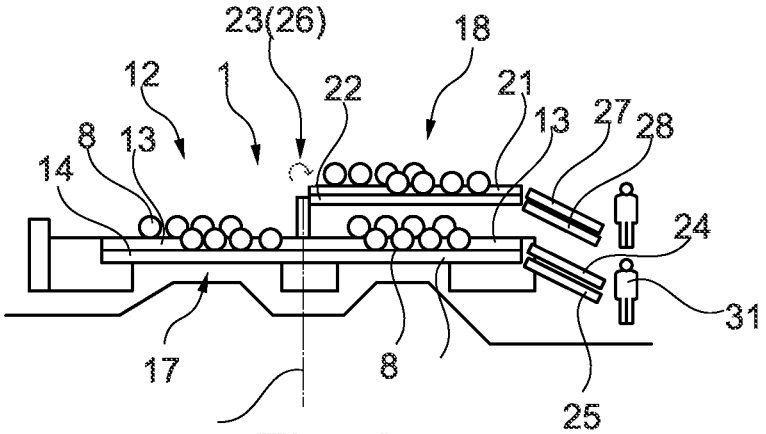
FIG. 3 is a schematic view of an alternative embodiment of a cross-wound package transport apparatus of an open-end rotor spinning machine, the cross wound package transport apparatus having a first transport device equipped with a cross-wound package handling apparatus, which is arranged in the centre of the machine and is connected to a second transport device arranged above the first transport device.

In the alternative embodiment shown in FIG. 3, the open-end rotor spinning machine 1 also has a cross-wound package transport apparatus 12 which has a first transport device 17 and a second transport device 18. In this case, however, the conveyor belts 21, 22 of the second transport device 18 are positioned above the conveyor belts 13, 14 of the first transport device 17. In other words, the first transport device 17 has two conveyor belts 13, 14 extending along the entire length of the machine, which are equipped with package handling apparatuses 23, 26, for example in the region of the machine centre 19 of the open-end rotor spinning machines 1.

By means of the package handling apparatuses 23, 26, the conveyor belts 13, 14 of the first transport device 17 are connected to the conveyor belts 21, 22 of the second transport device 18, which are preferably positioned significantly above the workstations 2. Similarly to the embodiment example according to FIG. 2, the conveyor belts 21, 22 are only half the length of the machine.

As with the embodiment example according to FIG. 2, in this case the conveyor belts 13, 14 of the first transport device 17 and the conveyor belts 21, 22 of the second transport device 18 are equipped with package removal apparatuses arranged at the end of the machine, the package removal apparatuses of the conveyor belts 13, 14 being denoted by the reference numerals 24, 25, and the package removal apparatuses of the conveyor belts 13, 14 being denoted by the reference numerals 27, 28.

The package handling apparatuses 23, 26 are preferably configured as cross-wound package lifting apparatuses, which lift cross-wound packages 8 from the conveyor belts 13, 14 of the first transport device 17 onto the conveyor belts 21, 22 of the second transport device 18 as necessary.

Figure 4:
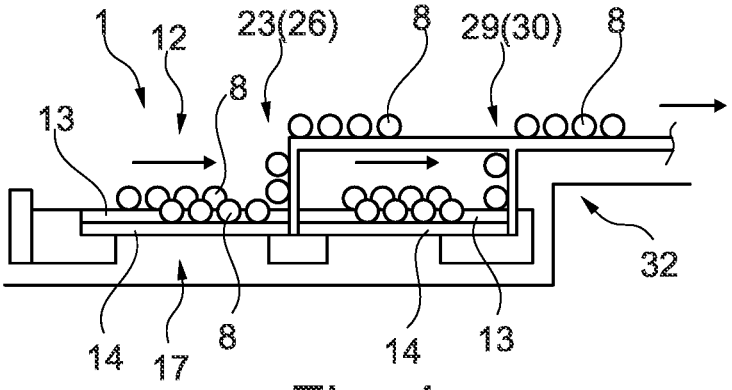
FIG. 4 is a schematic view of a further embodiment of a cross-wound package transport apparatus for open-end rotor spinning machines, comprising a first transport device equipped with one cross-wound package handling apparatus arranged in the centre of the machine and one arranged at the end of the machine, each of which is connected to a separate downstream transport device.

In the embodiment shown in FIG. 4, the open-end rotor spinning machine 1 also has a cross-wound package transport apparatus 12, which has a first transport device 17 having two conveyor belts 13, 14 extending along the entire length of the machine. Package handling apparatuses 23, 26, 29, 30, which are configured for example as cross-wound package lifting apparatuses, are connected to the conveyor belts 13, 14 of the first transport device 17 and, as necessary, lift the finished cross-wound packages 8 delivered to the conveyor belts 13, 14 off said conveyor belts 13, 14 and onto a transport apparatus 32 arranged downstream of the first transport device 17, which transport apparatus passes the cross-wound packages 8 on to textile machines arranged downstream in the production process, such as weaving machines. The package handling apparatuses 23, 26 are, for example, arranged in the region of the machine centre 19 of the open-end rotor spinning machines 1, whereas the package handling apparatuses 29, 30 are positioned at the end of the open-end rotor spinning machine 1.

The functioning of the package transport device 12 according to the invention will be briefly explained below with reference to FIG. 3:

When workstations 2 arranged in the rear region of the open-end rotor spinning machine 1, i.e. positioned in the region of the open-end rotor spinning machine 1 to the right of the machine centre 19 in FIG. 3, have finished cross-wound packages 8, these are transferred by a service unit, preferably by a package doffer 16, to the associated conveyor belt 13 or 14 of the first transport device 17, which, as shown in FIG. 1, is installed downstream of the winding devices 4 of the workstations 2. By means of the first transport device 17, the cross-wound packages 8 are then conveyed to a package removal apparatus 24 or 25 arranged at the end of the machine, where they are immediately unloaded, for example by an operator 31.

Cross-wound packages 8 completed on workstations 2 arranged in the front region of the open-end rotor spinning machine 1, i.e. in the region to the left of the machine centre 19, are initially transferred to one of the conveyor belts 13 or 14 of the first transport device 17 by a package doffer 16.

The first transport device 17 then conveys the cross-wound packages 8 to package handling apparatuses 23 or 26 arranged in the region of the machine centre 19. The package handling apparatuses 23 or 26, which are preferably configured as cross-wound package lifting apparatuses, transfer the cross-wound packages 8 to a second transport device 18, the conveyor belts 21 and 22 of which are arranged above the conveyor belts 13, 14 of the first transport device 17.

The conveyor belts 21 and 22 of the second transport device 18 also have package removal apparatuses 27 and 28, which are arranged at the end of the machine and by means of which the cross-wound package 8 can then be immediately unloaded.

Any of the above-described embodiments of a cross-wound package transport apparatus 12 lead to considerable correction of the transport of finished cross-wound packages 8. In other words, the hitherto common backlog of finished cross-wound packages 8, which started in the machine-end region of the cross-wound package transport apparatus 12 of the open-end rotor spinning machines 1 and often caused the stoppage of the workstations 2 arranged in this region of the backlog, can be reliably prevented by the embodiments according to the invention.

LIST OF REFERENCE SIGNS

1 Open-end rotor spinning machine
2 Workstation
3 Spinning device
4 Winding device
5 Spinning can
6 Fibre band
7 Thread
8 Cross-wound package
9 Package cradle
10 Rail
11 Winding roller
12 Cross-wound package transport apparatus
13 Conveyor belt
14 Conveyor belt
15 Pivot axis
16 Package doffer
17 First transport device
18 Second transport device
19 Machine centre
20 Rail
21 Conveyor belt
22 Conveyor belt
23 Package handling apparatus
24 Package removal apparatus
25 Package removal apparatus
26 Package handling apparatus
27 Package removal apparatus
28 Package removal apparatus
29 Package handling apparatus
30 Package handling apparatus
31 Operator
32 Transport means

What is claimed is:

1. A textile machine for producing cross-wound packages, the textile machine being equipped with a plurality of workstations arranged next to one another on both longitudinal sides of the machine and having a cross-wound package transport apparatus, the cross-wound package transport apparatus having a first transport device, arranged between the two rows of workstations for conveying cross-wound packages, and a handling apparatus for moving cross-wound packages from the first transport device to a second transport device, characterised in that the handling apparatus is arranged between end regions of the first transport device and the handling apparatus is configured as a cross-wound package lifting apparatus, which takes the cross-wound packages from the first transport device and transfers the cross-wound packages to the second transport device.

2. The textile machine for producing cross-wound packages according to claim 1, characterised in that the handling apparatus is arranged in a region of the machine centre.

3. The textile machine for producing cross-wound packages according to claim 1, characterised in that the handling apparatus is movable between the end regions of the first transport device.

4. The textile machine for producing cross-wound packages according to claim 1, characterised in that the second transport device is arranged above the first transport device.

5. The textile machine for producing cross-wound packages according to claim 1, characterised in that the second transport device is positioned next to the first transport device in each case.

6. The textile machine for producing cross-wound packages according to claim 1, characterised in that a package removal apparatus is installed both at the end of the first transport device and at the end of the second transport device.

7. A textile machine for producing cross-wound packages, the textile machine being equipped with a plurality of workstations arranged next to one another on both longitudinal sides of the machine and having a cross-wound package transport apparatus, the cross-wound package transport apparatus having a first transport device, arranged between the two rows of workstations for conveying cross-wound packages, and a handling apparatus for moving cross-wound packages from the first transport device to a second transport device, characterised in that the handling apparatus is arranged between end regions of the first transport device, and the first transport device has two conveyor belts, which are arranged next to one another and are driven in a defined manner.

8. The textile machine for producing cross-wound packages according to claim 7, characterised in that each of the two conveyor belts of the first transport device is equipped with its own handling apparatus.

9. A textile machine for producing cross-wound packages, the textile machine being equipped with a plurality of workstations arranged next to one another on both longitudinal sides of the machine and having a cross-wound package transport apparatus, the cross-wound package transport apparatus having a first transport device, arranged between the two rows of workstations for conveying cross-wound packages, and a handling apparatus for moving cross-wound packages from the first transport device to a second transport device, characterised in that the handling apparatus is arranged between end regions of the first transport device, and there are a plurality of handling apparatuses and the plurality of handling apparatuses are arranged both between the end regions of the first transport device and at the end of the first transport device, and transfer finished cross-wound packages to the second transport device.

* * * * *